US006942167B2

(12) United States Patent
Fleissner

(10) Patent No.: US 6,942,167 B2
(45) Date of Patent: Sep. 13, 2005

(54) NOZZLE BODY FOR PRODUCING VERY FINE LIQUID JET FLOWS ON WATER NEEDLING DEVICES

(75) Inventor: Gerold Fleissner, Zug (CH)

(73) Assignee: Fleissner GmbH & Co. Maschinenfbrik, Egelsbach (DE)

( * ) Notice: Subject to any disclaimer, the term of this patent is extended or adjusted under 35 U.S.C. 154(b) by 0 days.

(21) Appl. No.: 10/381,030

(22) PCT Filed: Sep. 18, 2001

(86) PCT No.: PCT/EP01/10753

§ 371 (c)(1),
(2), (4) Date: Sep. 25, 2003

(87) PCT Pub. No.: WO02/24998

PCT Pub. Date: Mar. 28, 2002

(65) Prior Publication Data

US 2004/0026543 A1 Feb. 12, 2004

(30) Foreign Application Priority Data

Sep. 21, 2000 (DE) ..... 100 47 1064

(51) Int. Cl.[7] ..... B05B 1/14; B05B 1/20; B05B 1/00

(52) U.S. Cl. ..... 239/555; 239/566; 239/591; 239/602; 239/DIG. 19

(58) Field of Search ..... 239/555, 566, 239/591, 602, DIG. 19, 548, 556, 557, 553.3, 589; 28/104–106; 68/201

(56) References Cited

U.S. PATENT DOCUMENTS 3,403,862 A * 10/1968 Dworjanyn ..... 239/566
3,613,999 A * 10/1971 Bentley et al. ..... 239/553.3
5,033,681 A * 7/1991 Munoz ..... 239/596
5,042,722 A * 8/1991 Randall et al. ..... 239/553.5
5,199,640 A * 4/1993 Ursic ..... 239/11
5,620,142 A 4/1997 Elkas
5,730,358 A * 3/1998 Raghavan et al. ..... 239/1
5,778,501 A * 7/1998 You ..... 28/104
5,806,155 A 9/1998 Henning
5,933,931 A * 8/1999 Greenway ..... 28/167

FOREIGN PATENT DOCUMENTS

| | | |
|---|---|---|
| DE | 198 49 814 | 5/2000 |
| DE | 199 21 694 | 11/2000 |
| DE | 199 41 729 | 3/2001 |
| EP | 0 119 338 | 9/1984 |
| GB | 2178342 | 2/1987 |
| WO | 01 15812 A | 3/2001 |
| WO | 01 44553 A | 6/2001 |

* cited by examiner

*Primary Examiner*—David A. Scherbel
*Assistant Examiner*—Darren Gorman
(74) *Attorney, Agent, or Firm*—Antonelli, Terry, Stout & Kraus, LLP

(57) ABSTRACT

The invention relates to jet flows on a nozzle beam for hydrodynamic water needling, formed inside a nozzle body which is supported as a component part on the nozzle strip. The aim of the invention is to ensure long-term secure positioning of the sapphire or similar material on the nozzle strip. According to the invention, the nozzle bodies are respectively held in place in a nozzle body support which is introduced via a foot part with a smaller diameter smaller into bores in the nozel strip.

8 Claims, 2 Drawing Sheets

FIG. 2
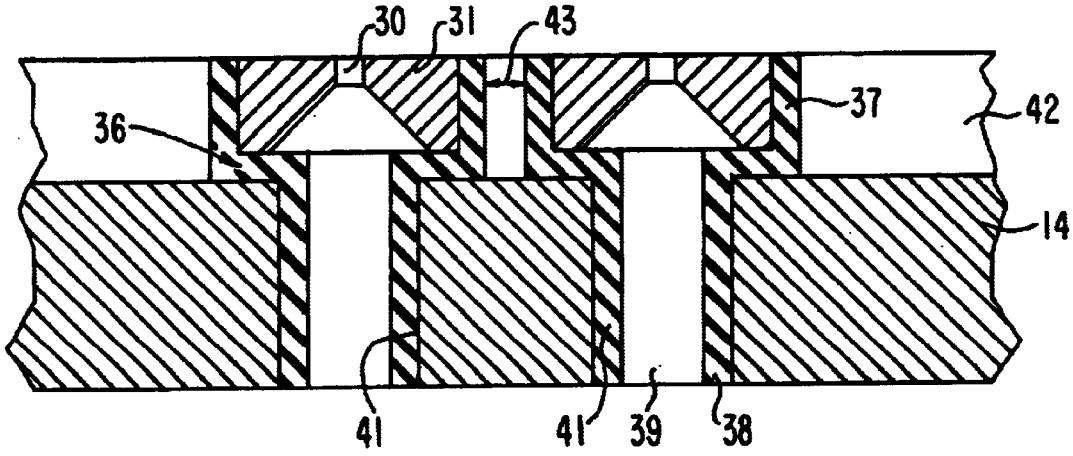
FIG. 3
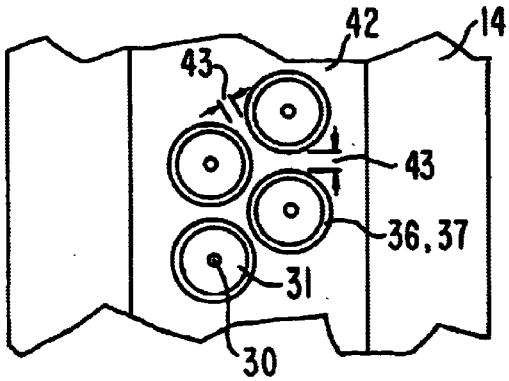
FIG. 5
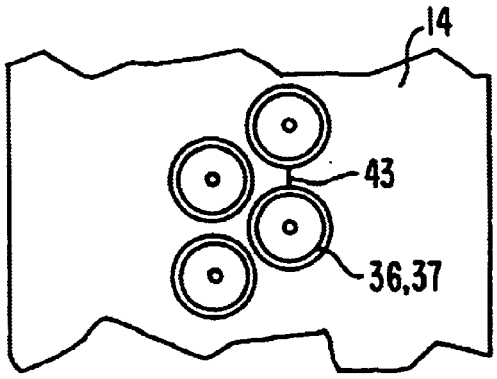
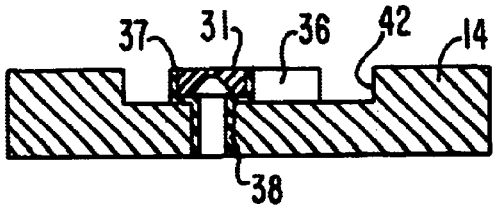
FIG. 4
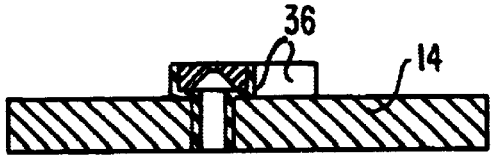
FIG. 6

NOZZLE BODY FOR PRODUCING VERY FINE LIQUID JET FLOWS ON WATER NEEDLING DEVICES

BACKGROUND OF THE INVENTION

The invention relates to a jet strip for producing very fine liquid streams for jet weaving of endless or finite fibers in webs of goods made of manmade or natural fibers in nonwovens, tissues, fabrics, or knits, which is preferably mounted in a fluid-tight manner in a nozzle beam that extends transversely to the traveling web of goods and corresponds in its length to the width of the web; a liquid pressure of up to 1000 bars is produced in the nozzle beam which presses the jet strip against a wall of the nozzle beam provided with a through-flow slot; a plurality of tiny holes with diameters of 0.08–0.15 mm are provided at a distance of 20–128 hpi apart, namely very close together, in the jet strip to produce the liquid jets; a hard metal or a ceramic, or sapphire, is selected as the material for the jet strip or the individual nozzle bodies in the jet strip, said material having the same or similar physical properties; and the jet strip or the individual nozzle bodies is supported over its surface by another material such as stainless steel.

A jet strip is known for example from EP-A-0 725 175. It extends over a large working width and is generally made of a thin sheet of stainless steel with holes produced mechanically for example. This jet strip or the holes produced therein has a geometry that has proven its worth in practice and continues to be improved, but which has only a short service life. The walls of the nozzle holes which individually are up to 0.1 mm in diameter must be extremely smooth so that the holes must be drilled or punched. The geometry of the holes is particularly important for formation of the water jet, so that in general a nozzle cross section that forms the water jet is followed by a diffuse conical part over the height of the nozzle hole; also so as not to break up the water jet once formed on the way to the end of the hole by friction against the walls of the hole. Because higher and higher water pressures are demanded and because of the continuous abrasion, the holes rapidly become clogged at the edges. This produces water jets that are neither sharp nor round, and deliver an unsatisfactory amount of energy in dynamic treatment of the web of goods.

DE-A-199 41 729 discloses another type of jet strip according to the species that avoids the above-mentioned problems. Each water jet is now produced by an individual nozzle body which is made of an extremely hard material and is supported only on the jet strip. Such nozzle bodies can be made of a sapphire for example, from which a nozzle hole with an extremely smooth wall can be made which exhibits no wear phenomena even after lengthy use at high water pressures. However, mounting the individual nozzle bodies on such a jet strip is no simple matter. In particular there is a risk that the nozzle bodies will not be exactly perpendicular to the lengthwise direction of the jet strip and that under a bending stress of the long jet strip, for example due to a stronger contact, they will become detached therefrom.

BRIEF SUMMARY OF THE INVENTION

With the above arrangement as a starting point, the goal of the invention is to find a mount for the individual nozzle body that ensures reliable alignment of the nozzle body in and on the jet strip and simultaneously ensures that, even when a bending stress is applied to the jet strip, individual nozzle bodies cannot come loose.

This goal is achieved in that only one group of these nozzle bodies, or preferably each one individually, is held by its own nozzle body carrier and the latter is supported on the jet strip. Thus, once the smooth-walled nozzle hole has been made, the sapphire has to fit exactly into a nozzle body carrier with a sharply beveled cone and must be held firmly therein. This purpose is served for example by a cylindrical wall in which the nozzle body is held against the radial inside wall and in the axial direction is held against a narrowed section of the inside wall. The narrowed section can be a reduction in diameter of a bore to receive the nozzle body. The nozzle body carrier can consequently consist of a cylindrical tube whose outside diameter is wider in the vicinity of the nozzle body, whereby a small tube of reduced diameter abuts the head-like carrier area of the nozzle body similarly to a hexagonal screw, said tube extending into the jet strip when assembled.

BRIEF DESCRIPTION OF THE SEVERAL VIEW OF THE DRAWINGS

An example of the jet strip carrying the nozzle bodies according to the invention is shown in the drawings.

FIG. 2 is a section through a jet strip with individual nozzle bodies, which are held in their own nozzle body carriers made of a different material in the jet strip;

FIG. 3 is a top view of the jet strip according to FIG. 2;

FIG. 4 is a cross section through the strip according to FIG. 3;

FIG. 5 is a top view of the jet strip according to FIG. 2, but with nozzle body carriers mounted on the top of the jet strip without a depression; and FIG. 6 is a cross section through the strip according to FIG. 5.

DETAILED DESCRIPTION OF THE INVENTION

Figure 1:
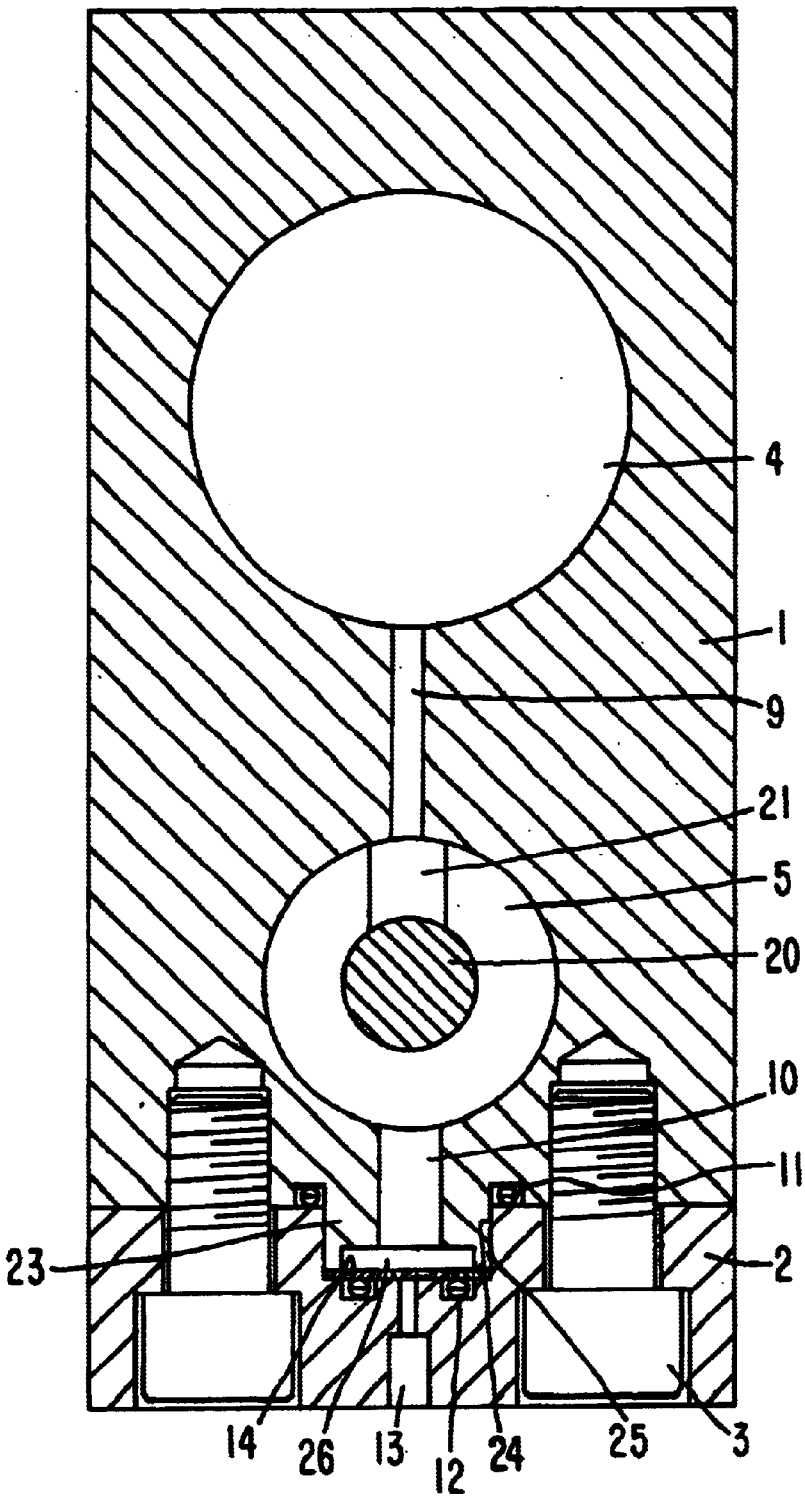
FIG. 1 is a cross section through a nozzle beam as disclosed in EP 0 725 175.

The housing of the nozzle beam consists of an upper part 1 screwed to the lower part 2 several times over the length by screws 3 from below. The upper part 1 has two bores 4 and lengthwise, the upper of which is pressure chamber 4 and the lower, pressure distribution chamber 5. The two chambers are open at one end and have been re-sealed in a fluid-tight manner by lids. The chambers 4 and 5 are separated from each other by a partition. Over the length of the nozzle beam, a large number of through-flow holes 9 in the partition connect the two chambers, so that the liquid flowing into the pressure chamber 4 flows, evenly distributed over the length, into pressure distribution chamber 5, in which an impact body 20 is additionally held against mounts 21. The pressure distribution chamber is open at the bottom, by a slot 10 which is narrow by comparison with the diameter of the bore in pressure distribution chamber 5, said slot likewise extending over the length of the beam.

According to FIG. 1, the upper part 1 is screwed firmly and in a fluid-tight manner to the lower part 2. The seal is produced by O-ring 11, which fits in an annular groove of upper part 1. In the middle between O-ring 11 a spring projection 23 surrounds slot 10 and fits into a matching groove 24 in lower part 2 and has a repair groove 26 for the O-ring 12, the outer edges 25 of said groove being directed against the edge of the jet strip 14. In the bottom of groove 24 of lower part 2, an annular groove is provided, in which O-ring 12 fits to seal off jet strip 14. In a line below the liquid through-flow holes 9 and slot 10, a slot 13 is also provided in lower part 2, said slot being very narrow in its upper area and leaving open only slightly more than the width of the effective nozzle openings of jet strip 14.

FIG. 1 is of importance only in conjunction with the mounting of the jet strip. The nozzle beam can have a completely different appearance, as for example according to DE-A1 99 21 694.

The jet strip 14 has a certain width, required to receive the nozzle holes 30 and for mounting above O-ring 12. The individual bodies 31 are attached on, or rather according to the invention, in, this jet strip 14. According to FIG. 2, the nozzle body consists of sapphire 31 with the central hole or nozzle hole 30, which expands after a short distance in depth to form a cone which is made very wide, possibly with an angle of 45°. The reasons for this wide opening are: the exact design of the jet strip in the actual nozzle 30, which is made very smooth in its walls and sharp-edged in the edge areas, and the adjoining zero-contact extent of the jet strip until it hits the textile to be treated, such as tissue or paper. This produces a high-energy jet.

A sapphire 31 of this type is held in a nozzle body carrier 36 by positive fit. The nozzle body carrier 31 is designed similarly to a hexagonal screw, i.e. with a head part 37 that receives the sapphire 31 centrically, and a foot part 38 through which an additional central bore 39 extends. The head part 37 has a larger diameter than the foot part 38 and is supported with its annular abutting surface 40 on the jet strip 14. Bores 41 are provided in jet strip 14 for receiving, by a positive fit, the nozzle body carrier 36 or its foot part 38. By means of this design, sapphire 31 is precisely aligned and durably held in jet strip 14.

It is advantageous for a groove 42 to be milled into the jet strip 14 according to FIGS. 3 and 4, the dimensions of said groove being provided only to accept the nozzle bodies 31, 36. The depth of groove 42 then corresponds to the height of head part 37 of nozzle body carrier 36 (see FIG. 4). Of course, groove 42 is not essential, as in the design of FIGS. 5 and 6. Bores 41 in jet strip 14 for the foot part 38 of nozzle body carrier 36 are preferably arranged in two rows and according to FIG. 3 are offset relative to each other and placed at a distance 43 apart that ensures that the head parts 37 of the nozzle body carrier 36 do not come in contact, not even if the jet strip 14 becomes bent in one direction or another. This ensures that the arrangement of the sapphire 31 in jet strip 14 remains exactly the same.

What is claimed is:

1. A jet strip (14) for producing very fine liquid jets for jet weaving of endless or finite fibers in webs of goods made of manmade or natural fibers in nonwovens, tissues, fabrics, or knits, to be mounted in a fluid-tight manner in a nozzle beam that extends transversely to the traveling web of goods and corresponds in its length to the width of the web; a liquid pressure of up to 1000 bars is produced in the nozzle beam which presses the jet strip against a wall of the nozzle beam provided with a through-flow slot, the jet strip comprising a plurality of individual nozzle bodies each having a hole with a diameter of 0.08–0.15 mm, the holes being provided at a distance of 2–128 hpi apart, to produce the liquid jets the plurality of individual nozzle bodies being made of a hard metal, a ceramic, or sapphire, and a plurality of cylindrical nozzle body carriers each comprising a cylindrical tube having a first portion for holding one of the individual nozzle bodies, the first portion having an outside diameter wider than a second portion supported on the jet strip.

2. Jet strip according to claim 1, characterized in that the second portion of each cylindrical tube of the nozzle body carrier, is held in a bore in the jet strip.

3. Jet ship according to claim 1, characterized in that the second portion of each cylindrical tube of the nozzle body carrier comprises a small thin-walled tube whose inside diameter ensures the free passage of the liquid jet without contacting an inside wall of the small thin walled tube.

4. Jet strip according to claim 1, characterized in that an inside diameter of each nozzle body carrier is expanded roundly at a head end so that each nozzle body is received with a positive fit and supported by each nozzle body carrier.

5. Jet strip according to claim 1, characterized in that the first portion of each nozzle body carrier is located in a depression of the jet strip.

6. Jet strip according to claim 5, characterized in that the depression comprises a groove milled into the surface of the jet strip, said groove corresponding in height to the height of the first portion of each nozzle body carrier.

7. Jet strip according to claim 1, characterized in that the nozzle body carriers are held closely together, but at a distance from one another in the jet strip.

8. Jet strip according to claim 7, characterized in that the nozzle body carriers are held in a groove offset from each other and in at least two rows.

* * * * *